US009550223B2

(12) United States Patent
Anjos

(10) Patent No.: US 9,550,223 B2
(45) Date of Patent: Jan. 24, 2017

(54) FLARING AND SWAGING BITS, AND METHODS USING SAME

(71) Applicant: Bruno Anjos, Sao Jose (BR)

(72) Inventor: Bruno Anjos, Sao Jose (BR)

( * ) Notice: Subject to any disclaimer, the term of this patent is extended or adjusted under 35 U.S.C. 154(b) by 0 days.

(21) Appl. No.: 14/947,537

(22) Filed: Nov. 20, 2015

(65) Prior Publication Data

US 2016/0074925 A1 Mar. 17, 2016

Related U.S. Application Data

(63) Continuation of application No. PCT/BR2013/000379, filed on Sep. 30, 2013.

(51) Int. Cl.

| | |
|---|---|
| ***B21D 39/08*** | (2006.01) |
| ***B21D 41/02*** | (2006.01) |
| *B21D 19/08* | (2006.01) |

(52) U.S. Cl.

CPC ..... *B21D 39/08* (2013.01); *B21D 41/021* (2013.01); *B21D 19/08* (2013.01)

(58) Field of Classification Search

CPC ... B21D 41/021; B21D 41/025; B21D 41/026; B21D 39/08; B21D 19/00; B21D 19/046; B21K 21/12; B21J 9/06; B21J 9/025

See application file for complete search history.

(56) References Cited

U.S. PATENT DOCUMENTS

2008/0006074 A1* 1/2008 Gaydusek ..... B21D 41/021 72/393

* cited by examiner

*Primary Examiner* — Debra Sullivan

(74) *Attorney, Agent, or Firm* — Hulsey P.C.

(57) ABSTRACT

Embodiments provide improved flaring and swaging bits, and methods for flaring and swaging.

20 Claims, 19 Drawing Sheets

METHOD 1800

METHOD 1900

FLARING AND SWAGING BITS, AND METHODS USING SAME

RELATED APPLICATION

This application is a continuation-in-part of PCT Application Serial No. PCT/BR2013/000379 filed 30 Sep. 2013, and pending, which is hereby incorporated by reference in its entirety.

FIELD

This disclosure is related to metal fabrication tools, and more specifically is related to flaring and swaging metal fabrication tools, and methods using the same.

BACKGROUND

Fitting metal tubes together often requires manual pounding or pressing of the ends of the metal tubes, so as to modify the ends to fit together. Fitting can be a very laborious and imprecise process. A few models of tools in the market are available to perform flares and swages, the majority being concentric flaring and swaging tools and eccentric flaring tools:

BRIEF SUMMARY

Disclosed subject matter provides flaring and swaging tools that avoid or reduce risk of cracking in the wall of tube being fitted. In an embodiment, flaring and swaging tools do not create flares or swages at room temperature, and thus do not harden the flared material to an undesirable degree, in this manner do not increase the risk of cracking the wall of the tube.

Disclosed subject matter eliminates the need for using an extra clamping tool when flaring and swaging, and eliminates the labor and time for a technician to couple the tube into a clamping tool. Disclosed subject matter eliminates the performing of flaring and swaging at room temperature, and thus avoids contributing to undesirable brittleness and susceptibility or risk of the wall cracking during fitting or thereafter, such as during expansion of the tube. In an embodiment, swaging and flaring tools require reduced or minimal spaced compared to previous tools, and methods for swaging and flaring with tools as disclosed may be performed during tube installation by a technician in less space than for previous tools and methods.

Disclosed subject matter may provide a rotary insert. The rotary insert may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry. The at least one stage portion may comprise rounded edges.

The disclosure may further comprise a system. The system may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry. The at least one stage portion may comprise rounded edges. The system may further comprise a drill engaging at least a portion of the shank portion.

The disclosed subject matter may further provide a method for flaring a tube. The method may comprise spinning a rotary insert coupled to one of a drill or screwdriver. The insert may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry. The at least one stage portion may comprise rounded edges. The tip may further comprise a flared bottom portion. The flared bottom portion may be affixed between the stopper portion and the at least one stage portion. At least two edges of the flared bottom portion may slope from the tip to the stopper portion.

In an embodiment, a method may further comprise inserting the rotary insert into an interior surface of a tube to cause friction between the tip and an interior surface of the tube, to increase the diameter of at least a portion of the tube, to create a flare, and to increase structural quality of the tube from heat provided to the tube.

The disclosure may further provide a method for swaging a tube. The method may comprise spinning a rotary insert coupled to one of a drill or screwdriver. The insert may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry. The at least one stage portion may comprise rounded edges.

A method may further comprise inserting the rotary insert into an interior surface of a tube to cause friction between the tip and an interior surface of the tube, to increase the diameter of at least a portion of the tube, and to increase structural quality of the tube from heat provided to the tube.

DETAILED DESCRIPTION OF ILLUSTRATIVE IMPLEMENTATIONS

Figure 1:
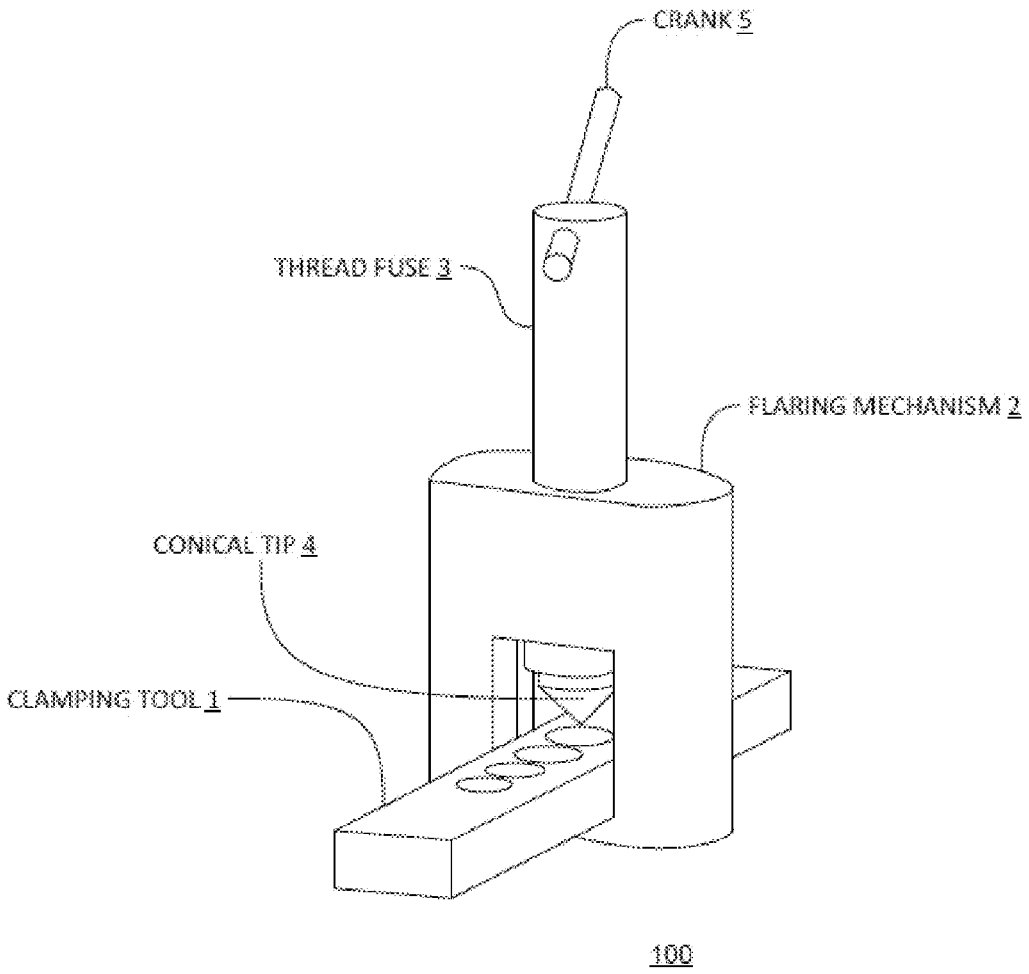
FIG. 1 PRIOR ART
FIG. 1 presents an isometric diagram of a concentric flaring tool, according to an implementation.

Reference now should be made to the drawings, in which the same reference numbers are used throughout the different figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

The present disclosure describes a metallic insert which, in some implementations, can be coupled into a rotary actuated mechanism, to flare or swage metallic tube ends. The actuation of the insert, in some implementations, can be performed by "drills" or "screwdrivers" and, as a final result, the insert is capable of creating flares and swages in metallic tubes, especially tubes applied to "split" air conditioning connection systems, refrigeration connection systems, and transportation of liquefied petroleum gas and any other similar tube, being much quicker and more resistant to cracks than conventional technology, due to the heat created by the friction of the insert spinning inside the metallic tube.

In embodiments, the insert may provide, to a tube, a flared opening at at least one of the tube's ends, such as, but not limited to, a 45 degree angle.

In embodiments, the insert may provide, to a tube, a swaged opening at at least one of the tube's ends, which may allow for the coupling of another tube with the same, or a larger, diameter.

In embodiments, the insert may provide, to a tube, a swaging opening with a flared opening, which may allow for the coupling of another tube with the same, or a larger, diameter.

Many industrial segments, especially the Heating, Ventilation and Air Conditioning (HVAC) industry, demand tools and equipment to simplify their day to day work, in order to optimize and reduce the production and work times. For example, there is a need to swage and flare metallic tubes of heat exchangers, such as copper tubes and aluminum tubes, to both manufacture condensating and evaporating units for residential, commercial, and industrial applications.

It will be understood that, as used herein, "tube" may include pipe or piping having a round, tubular cross section.

FIG. 1 presents an isometric view of a concentric flaring or swaging tool 100, according to an implementation. The concentric flaring or swaging tools are characterized by possessing a clamping tool 1, to affix the tube, and a flaring or swaging mechanism 2. The flaring or swaging mechanism 2 is compound by a fixing body, to attach the flaring or swaging mechanism 2 into the clamping tool 1, and a thread fuse 3, which at one end has a crank 5 and the other end has a conical tip, 4 that can be extended into a longer tip for swaging, with a 45 degree angle, to be performed at room temperature.

Figure 2:
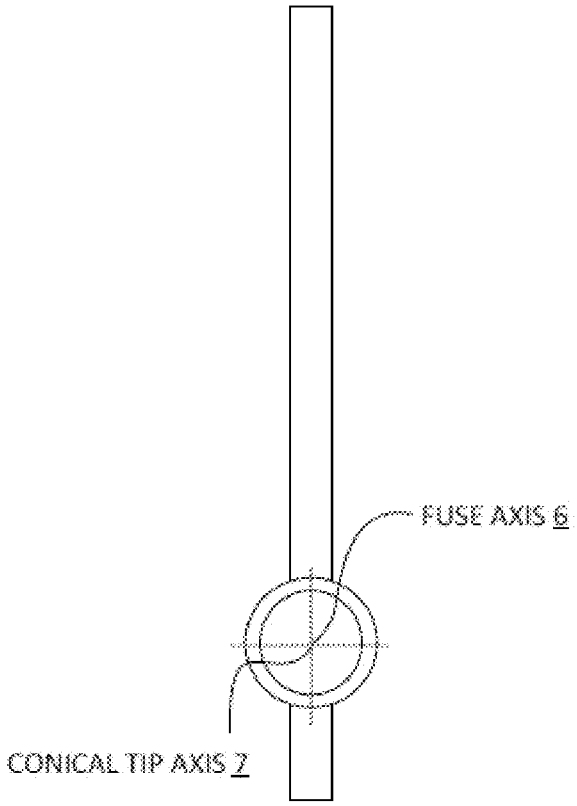
FIG. 2 PRIOR ART
FIG. 2 presents a bottom view of the alignment between the fuse axis and conical tip axis of the isometric flaring tool, according to an implementation.

FIG. 2 presents a bottom view of the alignment between the fuse axis and conical tip axis of the flaring or swaging tool 100, according to an implementation. The coupling between the flaring or swaging mechanism 2 and the thread fuse 3 is characterized by the concentric alignment between the fuse axis 6 and the conical tip axis 7. During the execution of flare, the contact zone between the conical tip and the tube is given through the whole surface of the cone, at room temperature.

Figure 3:
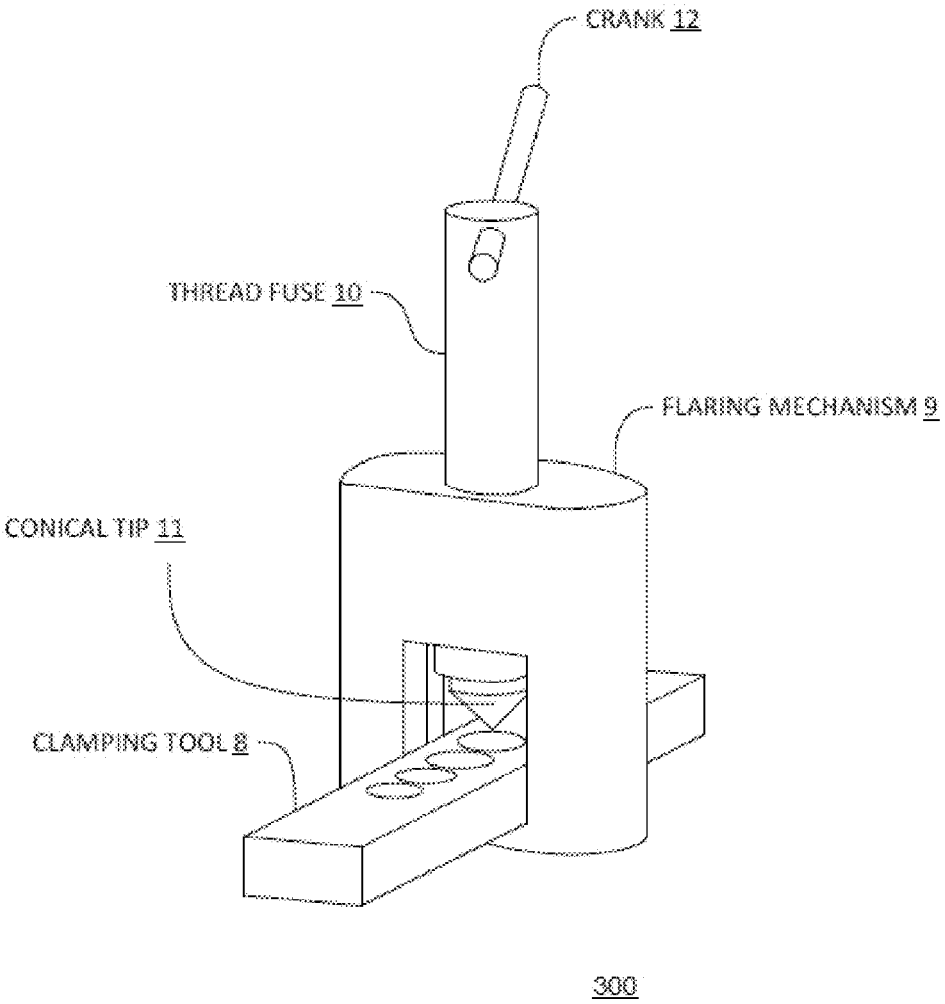
FIG. 3 PRIOR ART
FIG. 3 presents an isometric diagram of an eccentric flaring tool, according to an implementation.

FIG. 3 presents an isometric view of an eccentric flaring tool 300, according to an implementation. The eccentric flaring tools are characterized by possessing a clamping tool 8, to affix the tube, and a flaring mechanism 9. The flaring mechanism 9 is compound by a fixing body, to attach the flaring mechanism 9 into the clamping tool 8, and a thread fuse 10, which at one end has a crank 12 and the other end has a conical tip 11, with a 45 degree angle to be performed at room temperature.

Figure 4:
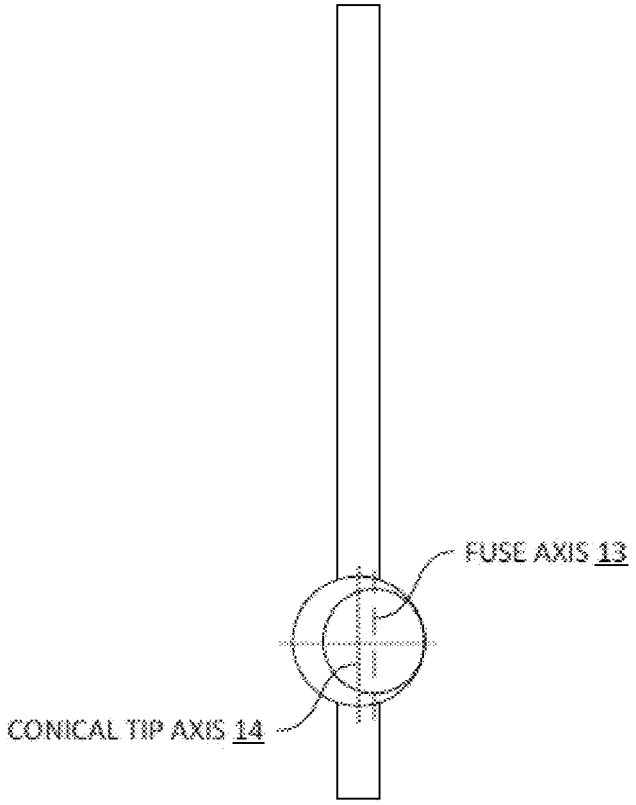
FIG. 4 PRIOR ART
FIG. 4 presents a bottom view of the alignment between the fuse axis and conical tip axis of the eccentric flaring tool, according to an implementation.

FIG. 4 presents a bottom view of the alignment between the fuse axis and conical tip axis of the eccentric flaring tool 300, according to an implementation. The coupling between the flaring mechanism 9 and the thread fuse 10 is characterized by the eccentric alignment between the fuse axis 13 and the conical tip axis 14. During the execution of flare, the contact zone between the conical tip and the tube is given through a linear contact with the cone, at room temperature.

Conventionally, there are many mechanisms to obtain a swaged or flared tube.

In embodiments, the bits may provide the ability to be coupled to a number of drills or screwdrivers.

In embodiments, a single flaring bit may provide the ability to create multiple flares in metallic tubes with different diameters without needing to use one or more other bits.

In embodiments, the bits do not need to be utilized with any clamping tools or holders during or after operation.

In embodiments, the bits may be utilized to perform a flare or swage at a hot temperature in order to avoid material hardening and, subsequently, cracking.

In embodiments, the bits may comprise a homogeneous and resistant microstructure due to the high temperature at which the bits may be formed.

During an air conditioning installation, especially the split types of air conditioners, at least four flaring are necessary for the installation. The split type air conditioners comprise two units: an indoor unit and an outdoor unit. To connect the outdoor unit and the indoor unit and make the two air conditioner units work together, the use of copper or aluminum tubes is required. Each tube has a different diameter, varying according to the refrigeration capacity of the equipment. As an example, for R-22 air conditioners, 7,000 BTUs/hour and 9,000 BTUs/hour equipment generally requires one ¼" tube and one ⅜" tube, while 12,000 BTUs/hour and 18,000 BTUs/hour equipment generally requires one ½" tube and one ¼" tube.

In embodiments, the rotary inserts 600, 700, 1000, 1100, 1200 in FIGS. 6, 7, 10, 11, and 12 speed up the flaring and swaging processes, by coupling two or more flaring or swaging stages of different diameters into one tool, creating a multiple-stage insert, which means that during installation procedures of equipment, the technician may only need to insert one insert into the drill or screwdriver and perform the four flares/swages for a specific job. Rotary insert 600 may comprise two-stage flaring bit 620. Rotary insert 700 may comprise two-stage flaring tip 720. Rotary insert 1000 and 1100 may comprise two-stage swaging tip 1020. Rotary insert 1200 may comprise two-stage swaging tip 1220. In embodiments, rotary inserts 600, 700, 1000, 1100, and 1200 comprise shank portion 40. In embodiments, rotary inserts 600, 700, 1000, 1100, and 1200 comprise stopper portion 50.

In embodiments, the rotary insert 500, 600, 700 for the flaring of metallic tubes (FIGS. 5, 6, and 7) may perform flares into metallic tubes through the flaring tip's multiple diameter stages and interchangeable system. The inserts, in some implementations, can be coupled into drills (whether the inserts are with a mechanical mandrel or pneumatic mandrel), screwdrivers, etc. Rotary insert 500 comprises a single-stage flaring tip 520 that may be used to flare metallic tubes. Rotary insert 500 further comprises flared bottom portion 530 that may provide a flare to a metallic tube. Rotary insert 500 comprises a stopper portion 50 found between the flared bottom portion 530 and the single-stage flaring tip 520.

Figure 5:
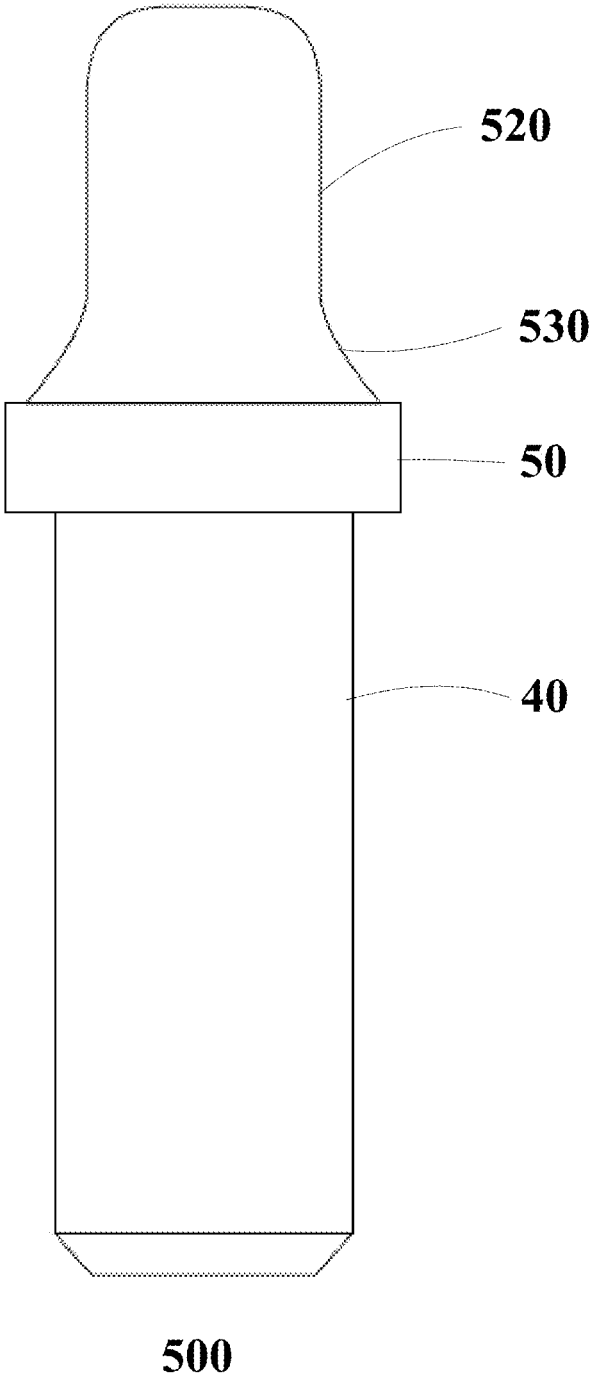
FIG. 5 presents a front view of a one-stage flaring tip, according to an implementation.

FIG. 5 presents a front view of a one-stage flaring tip 500, according to an implementation. The flared bottom portion 530 of the head of the flaring tip 500 may allow the head to flare a portion of a tube when the tip is inserted into a tube.

Figure 6:
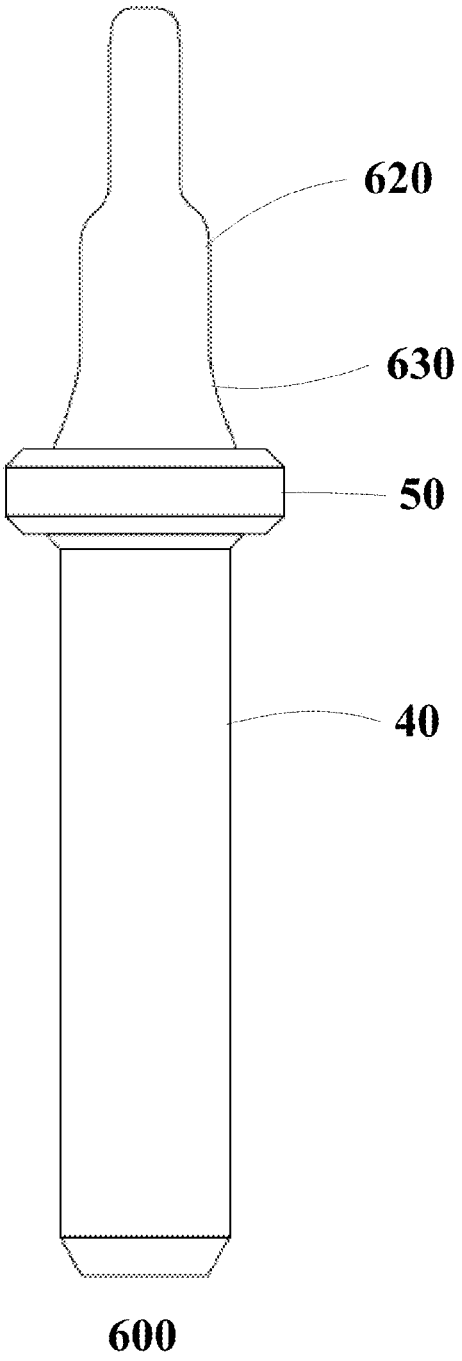
FIG. 6 presents a front view of a two-stage flaring tip, according to an implementation.
Figure 7:
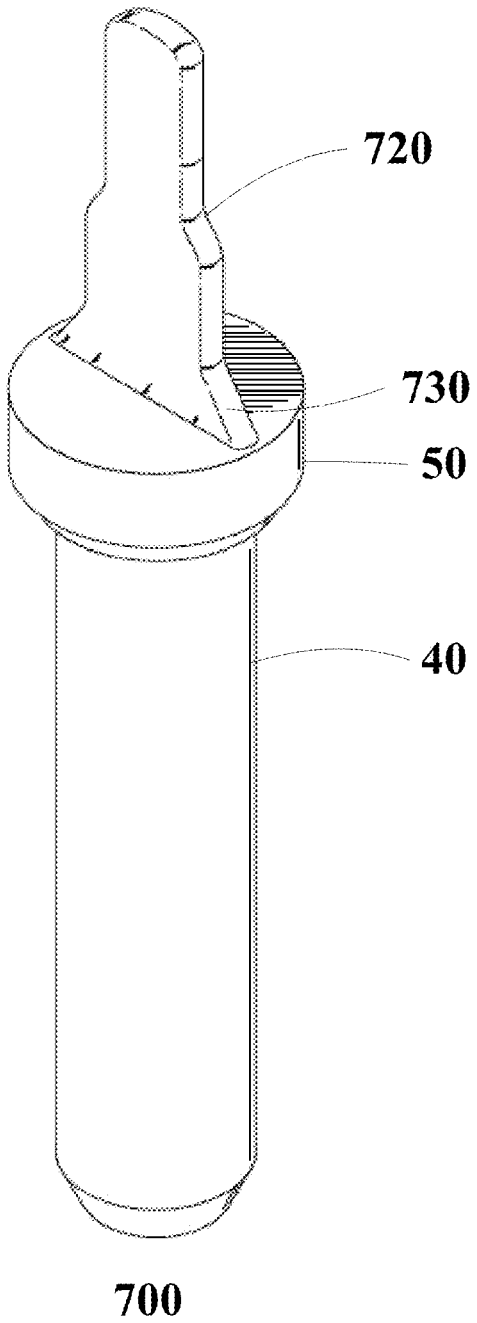
FIG. 7 presents an isometric view of a two-stage flaring tip, according to an implementation.

FIGS. 6 and 7 present front and isometric views of rotary inserts 600 and 700 according to an implementation. The inserts 600,700 comprise shank portions 40 that may be inserted into the mandrel or chuck of a screwdriver or drill. The inserts 600,700 further comprise two-stage flaring tips 620,720 comprising two stages of different diameters and a flared bottom portion 630, which may fit into the inner diameter of a metallic tube to create a flared end that may properly fit onto the outer diameter of another metallic tube. The inserts 600,700 further include stopper portions 50 located between the shank portions 40 and the flared bottom portions 630,730 that may allow the user to more easily flare a tube of the appropriate length. In embodiments, the inserts may comprise, but are not limited to having, a cylindrical, hexagonal, or square shank portion 630,730 with 8 mm of diameter, which may couple with a drill or screwdriver through their mandrels or chuck. The flared bottom portion 630 of rotary insert 600 may create a flare that has a smaller opening angle that that of an opening angle of a flare that had been flared by the flared bottom portion 730 of rotary insert 700.

Figure 8:
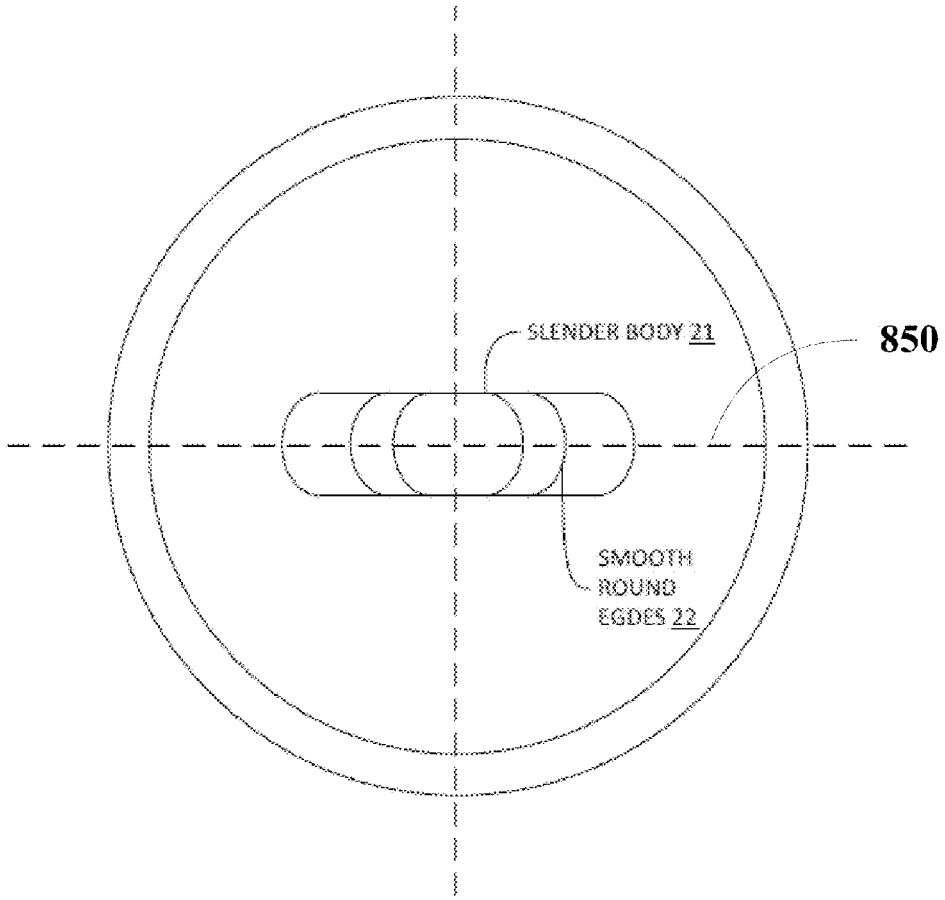
FIG. 8 presents a top view of a contact surface between a flaring tip and the metallic tube, according to an implementation.

FIG. 8 presents a top profile view of the two-stage flaring tip 620 of rotary insert 600 according to an implementation. The flaring tip 620 comprises a slender body 21 and smooth rounded edges 22, which may diminish the contact surface between the two-stage flaring tip 620 and the metallic tube. In embodiments, the slender body 21 and smooth rounded edges 22 may decrease heat and burr formation that may develop at the front of the flaring tip 620 during traditional flares. Stopper portion 50 may be found circumnavigating the two-stage flaring tip 620. FIG. 8 further displays an axis of symmetry 850. The length of the flaring tip 620 may run along the axis of symmetry 850.

Figure 9:
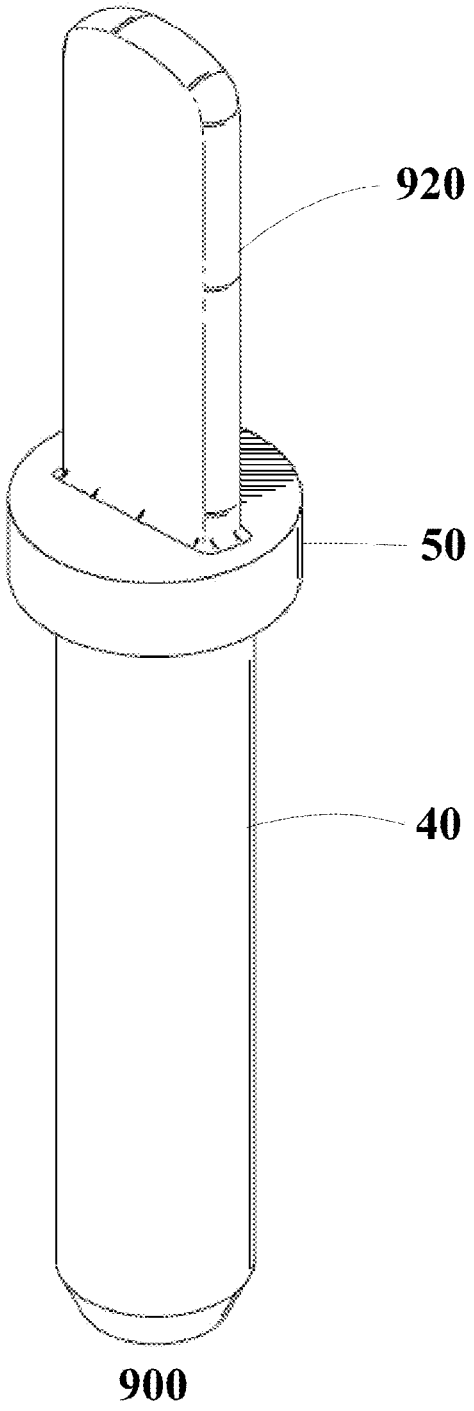
FIG. 9 presents an isometric view of a one-stage swaging tip, according to an implementation.

FIG. 9 presents an isometric view of a rotary insert 900 according to an implementation. In embodiments, the insert 900 comprises a one-stage swaging tip 920, which may fit into the inner diameter of a metallic tube to create a widened end to properly fit onto the outer diameter of another metallic tube. Stopper portion 50 may be found below swaging tip 920. Shank portion 40 may be found below stopper portion 50.

Figure 10:
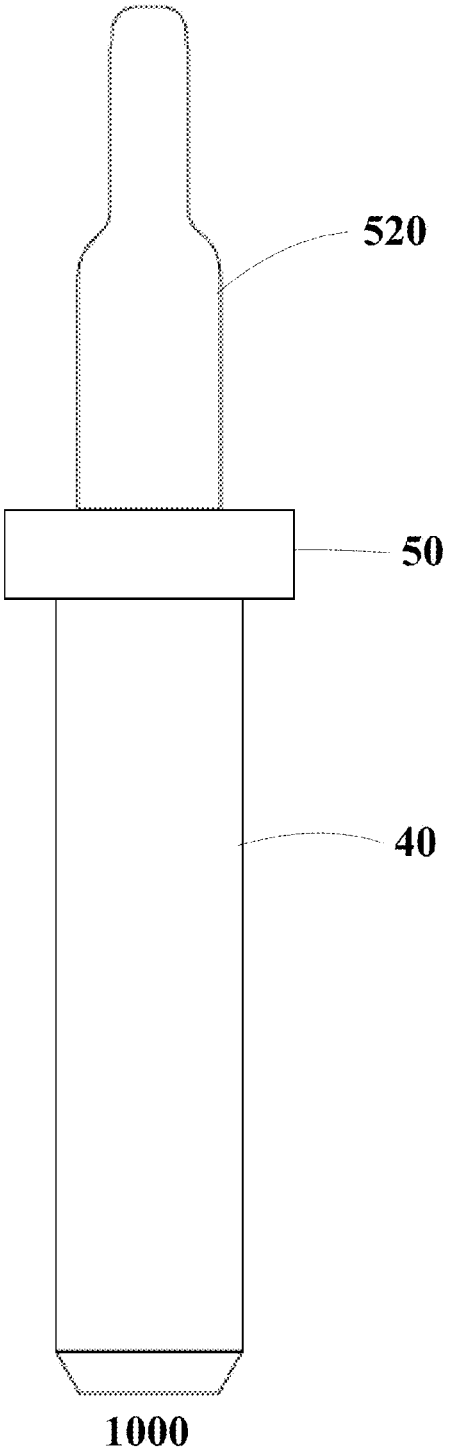
FIG. 10 presents a front view of a two-stage swaging tip, according to an implementation.

FIG. 10 presents a front view of a rotary insert 1000 according to an implementation. In embodiments, the insert includes a swaging tip 1020 comprising two stages, which means that it comprises a least two different diameters in a single tool, which may fit into the inner diameter of a metallic tube to create a widened end to properly fit onto the outer diameter of another metallic tube. Stopper portion 50 may be found below swaging tip 1020. Shank portion 40 may be found below stopper portion 50.

Figure 11:
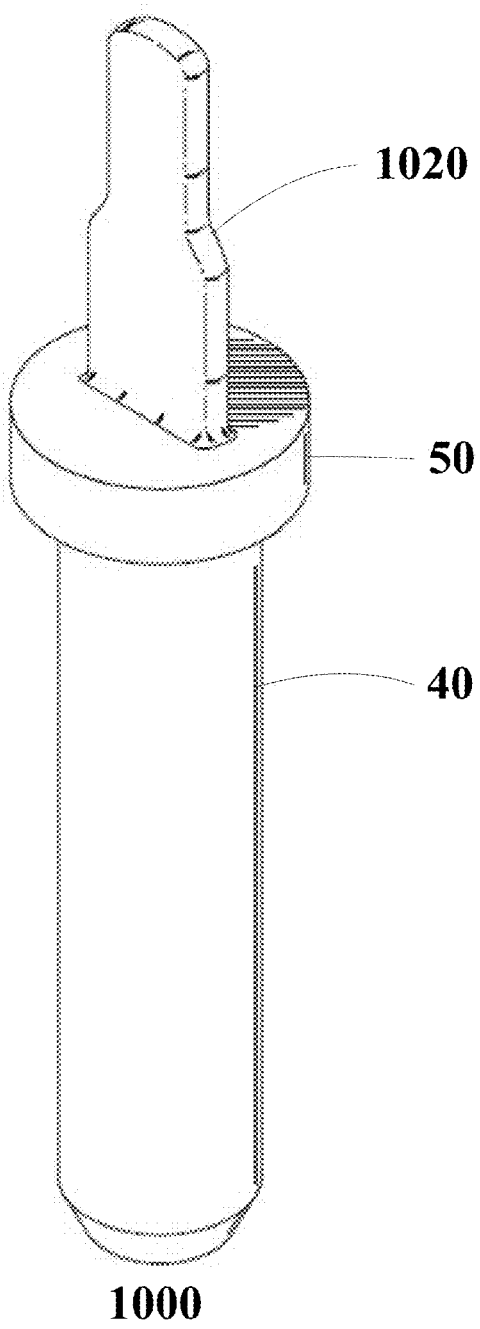
FIG. 11 presents an isometric view of a two-stage swaging tip, according to an implementation.
Figure 12:
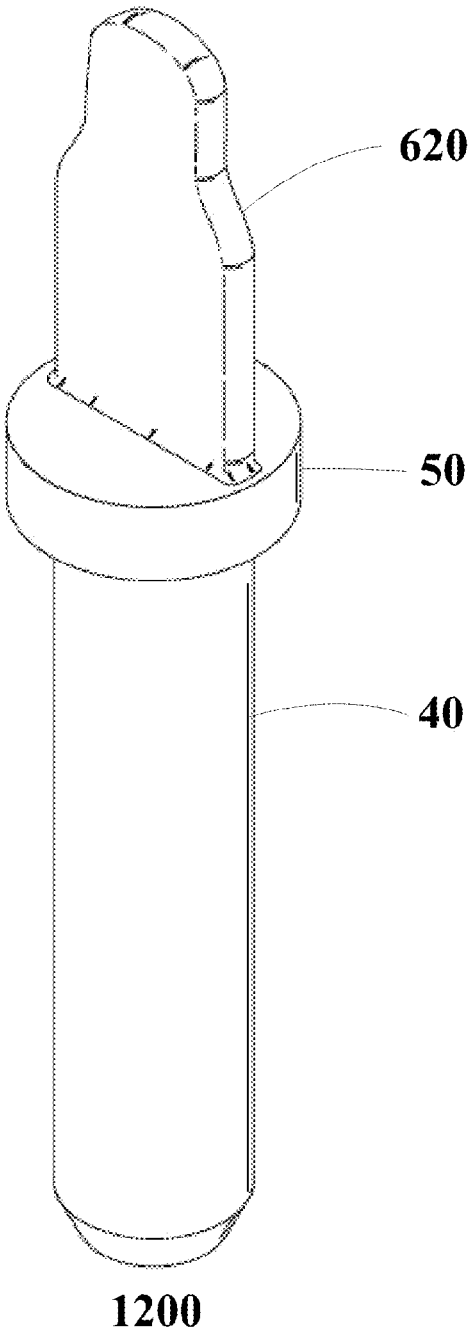
FIG. 12 presents an isometric view of a two-stage swaging tip, according to an implementation.

FIGS. 11 and 12 present isometric views of rotary insert 1000 and rotary insert 1200 according to an implementation. In an embodiment, the rotary insert 1000 and 1200 each comprise a swaging tip containing two stages 1020, 1220, which means, they have at least two different diameters in one single tool, which may fit into the inner diameter of a metallic tube to create a widened end to properly fit onto the outer diameter of another metallic tube. In embodiments, rotary insert 1200 may be utilized in a tube with a larger diameter that may not allow for swaging from rotary insert 1000. In embodiments, rotary insert 1200 may provide a larger swage to a tube than rotary insert 1000. Stopper portions 50 may be found below swaging tips 1020 and 1220. Shank portions 40 may be found below stopper portions 50.

Figure 13:
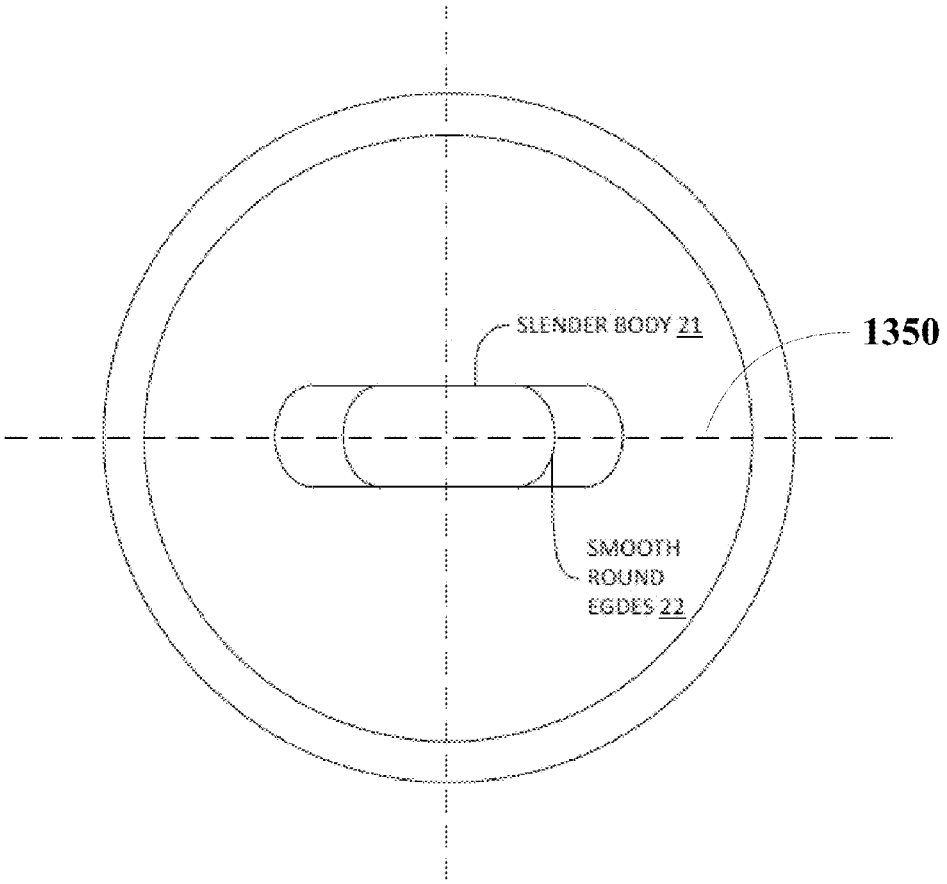
FIG. 13 presents a top view of a contact surface between a flaring tip and the metallic tube, according to an implementation.

FIG. 13 presents a top profile view of a two-stage swaging tip 1020 according to an implementation. The swaging tip 1020 has a slender body 21 and smooth rounded edges 22, which may diminish the contact surface between the two-stage swaging tip 1020 and the metallic tube. In embodiments, the slender body 21 and smooth rounded edges 22 may decrease heat and burr formation that may develop at the front of the swaging tip 1020 during the swage. Stopper portion 50 may be found circumnavigating the two-stage swaging tip 1020. FIG. 13 further displays an axis of symmetry 1350. The length of the swaging tip 1320 may run along the axis of symmetry 1350.

Figure 14:
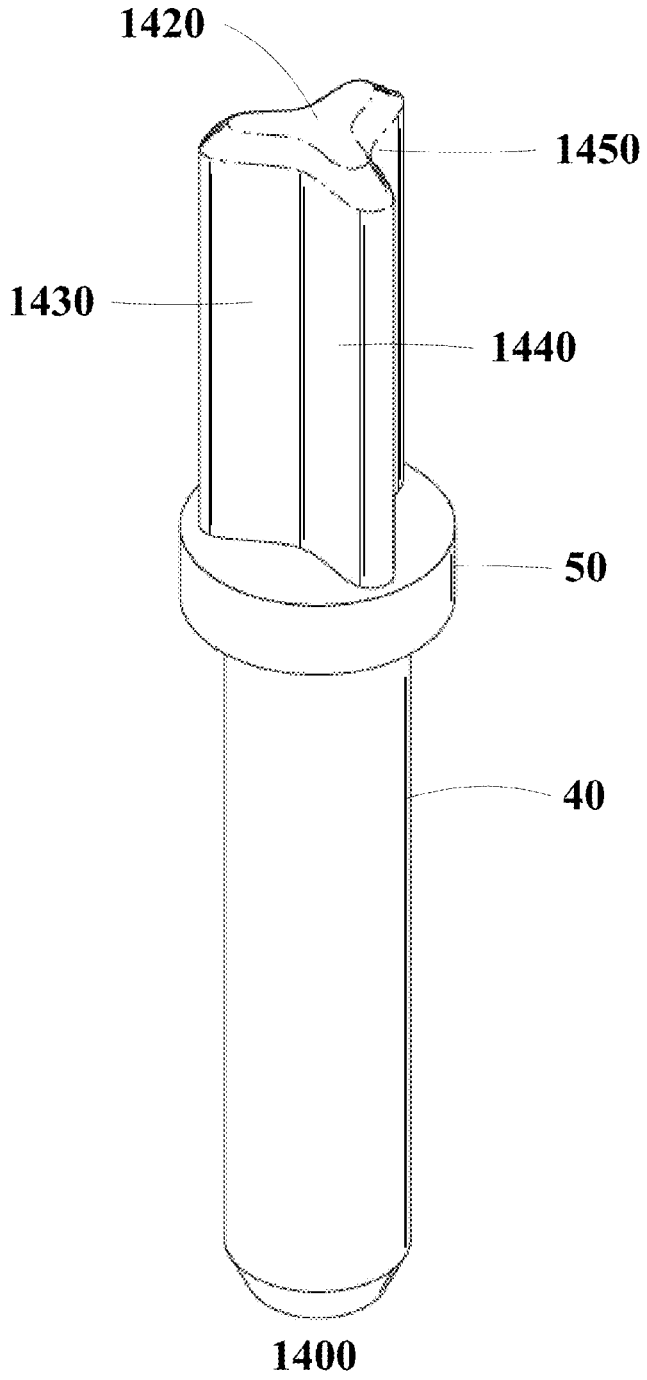
FIG. 14 presents an isometric view of a one-stage swaging tip with three swaging lobes, according to an implementation.

FIG. 14 presents an isometric view of a rotary insert 1400 according to an implementation. In an embodiment, the insert 1400 may include a one-stage swaging tip 1420 with three swaging lobes 1430, 1440, 1450, which may fit into the inner diameter of a metallic tube to create a widened end to properly fit onto the outer diameter of another metallic tube.

In embodiments, the lobes may comprise an equal angle between them in order to enhance stability while swaging. In embodiments, the three swaging lobes may comprise flared bottom portions, thus making the one-stage swaging tip 1420 a one-stage flaring tip. In embodiments, the one-stage swaging tip 1420 may comprise two stages, thus making the one-stage swaging tip 1420 a two-stage swaging tip. Stopper portion 50 may be found below swaging tip 1420. Shank portion 40 may be found below stopper portion 50.

Figure 15:
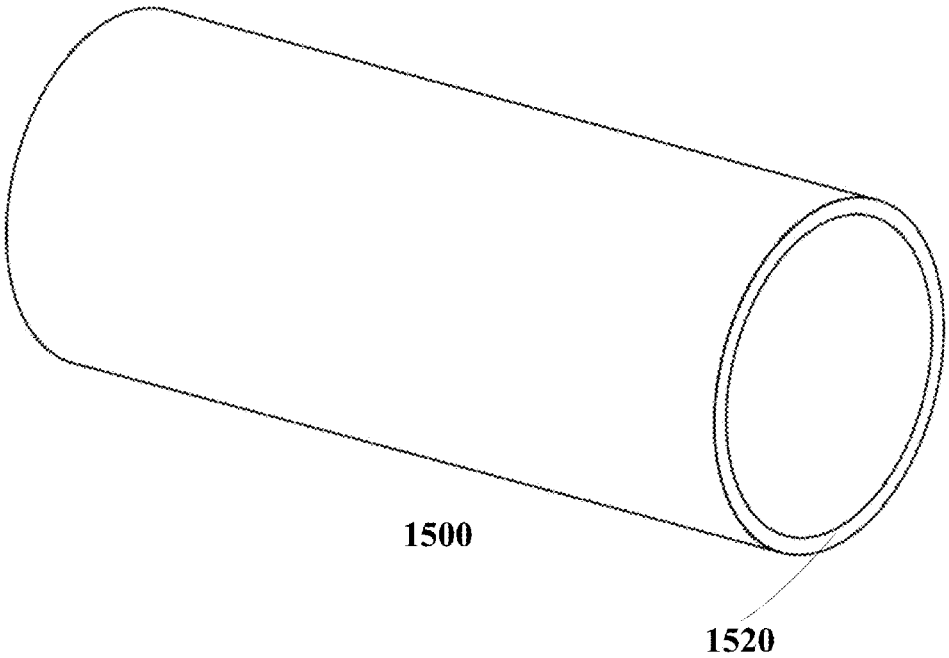
FIG. 15 presents an isometric view of a tube end before being flared or swaged, according to an implementation.

FIG. 15 presents an isometric view of a tube 1500, which a flaring tip or swaging tip may be inserted into, according to an implementation. The metallic tube end 1520 at this stage has not been flared or swaged by a flaring tip or a swaging tip.

Figure 16:
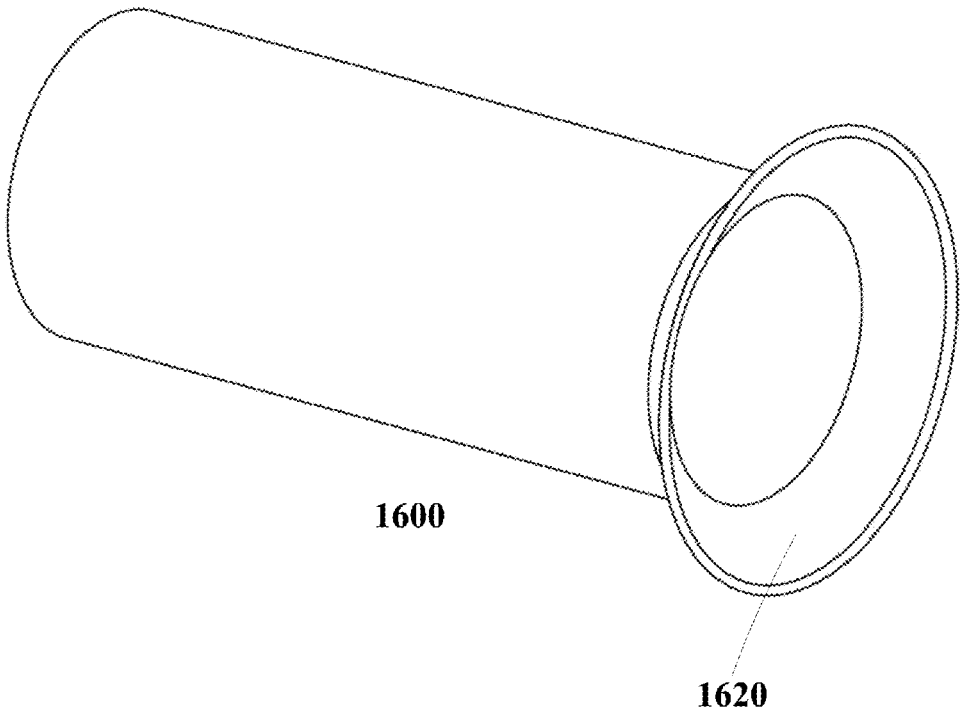
FIG. 16 presents an isometric view of a flared end of a tube, according to an implementation.

FIG. 16 presents an isometric view of a tube 1600 that has been flared by a flaring tip, such as, but not limited to flaring tip 500, according to an implementation. FIG. 16 shows the flare shape 1620 created by a flaring tip. In embodiments, the flare shape 1620 may comprise an angle ranging between 30° and 60°.

Figure 17:
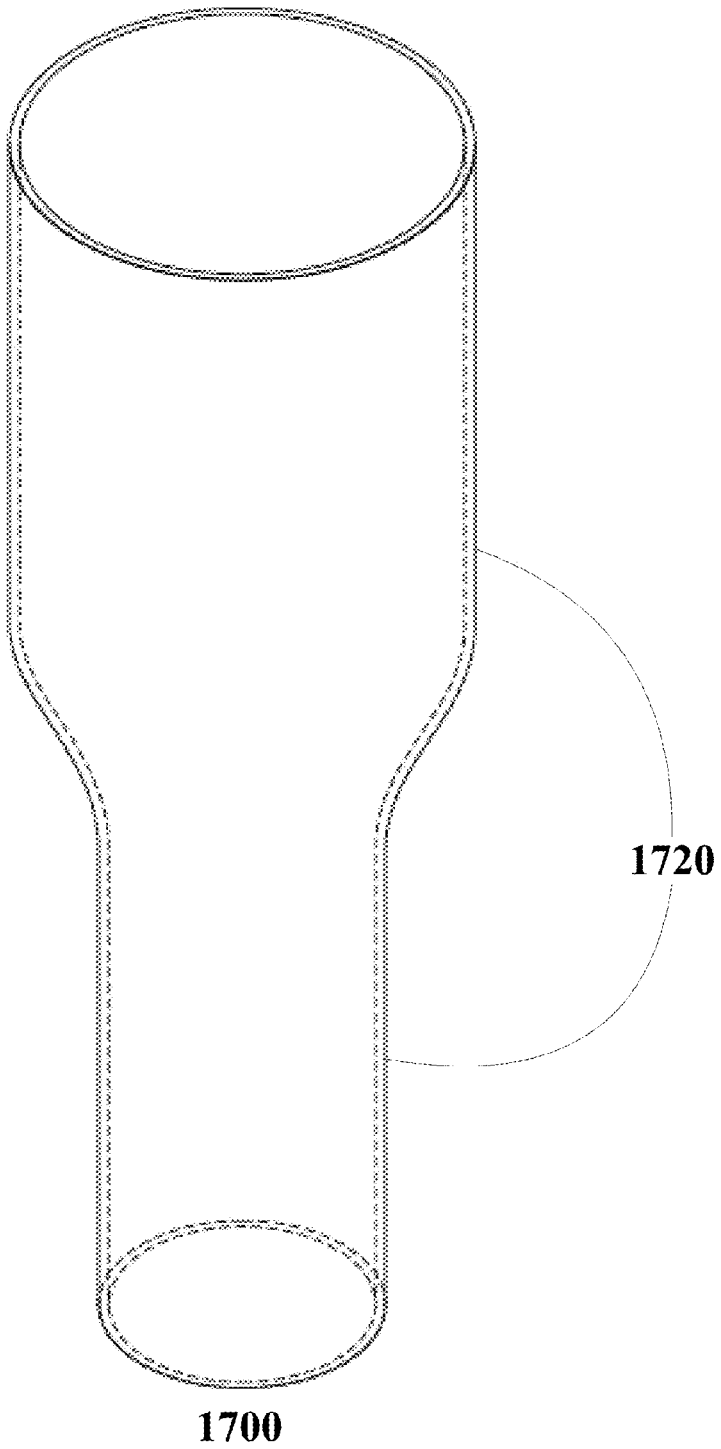
FIG. 17 presents an isometric view of a tube that has been swaged by a two-stage swaging tip, according to an implementation.

FIG. 17 presents an isometric view of a tube 1700 that has been swaged by a two-stage swaging tip such as, but not limited to two-stage swaging tip 1100 and 1200, according to an implementation. FIG. 17 shows the double swaged shape 1720 created by a swaging tip.

In embodiments, the bits may be composed of separate parts that may be connected by any connection method, including but not limited to, screwing, gluing, welding, etc.

Whenever a metallic tube is cut, the cutting may create sharp inner edges around the perimeter of the metallic tube due to material deformation and design of the cutting tool. In embodiments, the swaging and flaring tips design may allow for the removal of sharp edges from the tube and may not permit the tube to crack easily.

In embodiments, the tips may not require any clamping or holding tool to perform a flare or swage in a metallic tube because the strength required to keep the metallic tube in position is low so a user can keep the tubes in the right position using his hands. The friction and ensuing heat generation (from the rotation of the tips) facilitate the shape formation of the flare or swage, which may increase malleability in the flared or swaged tip of the metallic tube. The lack of hardening in the flared or swaged tip may prevent cracking at the flared or swaged tube end during the assembling of a metallic tube with a valve using a connection nut, which is a recurring problem during any air conditioning installation.

Figure 18:
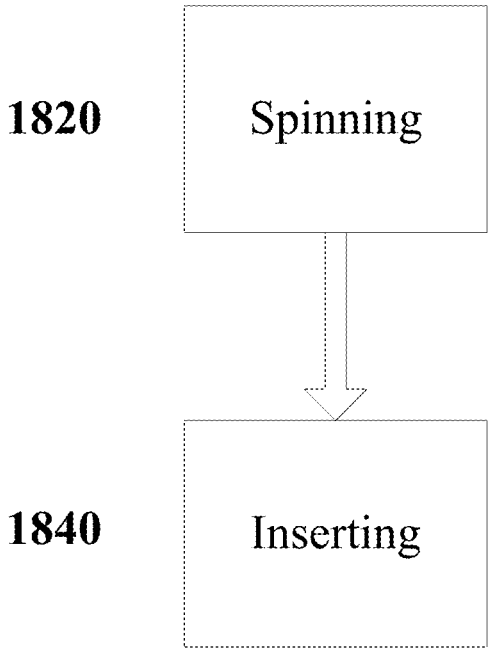
FIG. 18 presents a method for flaring a tube in accordance with embodiments.

FIG. 18 displays a method 1800 for flaring a tube. The method 1800 may comprise spinning 1820 a rotary insert coupled to one of a drill or screwdriver. The insert may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry. The at least one stage portion may comprise rounded edges. The tip may further comprise a flared bottom portion. The flared bottom portion may be affixed between the stopper portion and the at least one stage portion. At least two edges of the flared bottom portion may slope from the tip to the stopper portion.

The method 1800 may further comprise inserting 1840 the rotary insert into an interior surface of a tube to cause friction between the tip and an interior surface of the tube, to increase the diameter of at least a portion of the tube, to create a flare, and to increase structural quality of the tube from heat provided to the tube.

Figure 19:
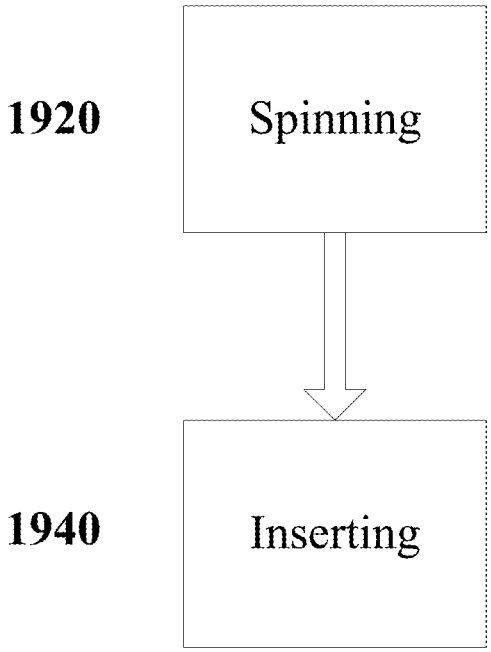
FIG. 19 presents a method for swaging a tube in accordance with embodiments.

FIG. 19 displays a method 1900 for swaging a tube. The method 1900 may comprise spinning 1920 a rotary insert coupled to one of a drill or screwdriver. The insert may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry. The at least one stage portion may comprise rounded edges.

The method 1900 may further comprise inserting 1940 the rotary insert into an interior surface of a tube to cause friction between the tip and an interior surface of the tube, to increase the diameter of at least a portion of the tube, and to increase structural quality of the tube from heat provided to the tube.

In embodiments, the flaring or swaging tips may be handled more easily than traditional flaring or swaging tools. In embodiments, the flaring or swaging tips may save a technician time when completing a job.

In embodiments, a rotary insert may be provided. The rotary insert may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry (such as that in FIG. 8 and FIG. 13). The at least one stage portion may comprise rounded edges.

In embodiments, a system may be provided. The system may comprise a shank portion comprising a top end, a bottom end, and a body. The insert may further comprise a stopper portion coupled to one of the top end and the bottom end of the shank portion. The stopper portion may comprise a top surface and a bottom surface. The insert may further comprise a tip comprising at least one stage portion coupled to one of the top surface and the bottom surface of the stopper portion along an axis of symmetry (such as that in FIG. 8 and FIG. 13). The at least one stage portion may comprise rounded edges. The system may further comprise a drill engaging at least a portion of the shank portion.

In embodiments, each of the at least one stage portion may be different in diameter than each of the other at least one stage portion.

In embodiments, the insert may be formed as a single element. In embodiments, the single element insert may be formed using a mold.

In embodiments, the insert may be formed from more than one element. For example, the shank portion, the stopper portion, and the tip may be single elements that may be affixed to one another. In embodiments, the separate elements may be welded together.

In embodiments, the insert may comprise metal. In embodiments, the insert may comprise ceramic.

In embodiments, the tip may further comprise a flared bottom portion. The flared bottom may be affixed between the stopper portion and the at least one stage portion. At least two edges of the flared bottom portion may slope from the tip to the stopper portion.

In embodiments, the rounded edges may be equal in diameter.

In embodiments, the insert may comprise one stage portion. In embodiments, the insert may comprise two stage portions.

For the purposes of this disclosure, the term "insert" may refer to the end of a bit that may be inserted and secured within a drill or screwdriver.

For the purposes of this disclosure, the terms "tube" and "pipe" may be synonymous.

In embodiments, a flaring or swaging bit may comprise more than two stages.

In embodiments, any of the embodiments of a rotary insert may comprise a shank portion 40. The shank portion 40 may be configured to fit within a mandrel, such as, but not limited to, a mandrel in a screwdriver or a drill.

In embodiments, any of the embodiments of a rotary insert may comprise a stopper portion 50. The stopper portion 50 may be found between a swaging tip and a shank portion 40 or (if a flaring bit) between a flared bottom and a shank portion 40. The stopper portion 50 may prevent a flaring or swaging bit from being inserted more than a certain length into a metallic tube.

In embodiments, the stopper portion 50 may comprise a single stage, such as that in FIG. 10. In embodiments, the stopper portion 50 may comprise multiple stages, such as that in FIG. 6.

In embodiments, the stopper portion 50 may be a shape other than that of a cylinder such as, but not limited to a rectangular prism, a hexagonal prism, and an octagonal prism.

In embodiments, inserts may be formed as a single element.

In embodiments, inserts may be formed from more than one element.

In embodiments, tubes to be flared or swaged may comprise polymer.

In embodiments, tubes to be flared or swaged may comprise wood.

For the purposes of this disclosure, the terms "stage" and "stage portion" may be synonymous.

In embodiments, the disclosure may provide optimization of the flaring or swaging process and optimization of time for altering metallic tubes for air conditioning installations, altering tubes for refrigeration applications, altering tubes for liquefied petroleum gas systems, or any similar flared or swaged connections. In embodiments, the flaring and swaging bits may improve the final quality of a flare or swage by adding heat through constant friction to a flared or swaged area, which may create a stronger micro structure.

Although specific embodiments are illustrated and described herein, it will be appreciated by those of ordinary skill in the art that any arrangement which is calculated to achieve the same purpose can be substituted for the specific embodiments shown. This application is intended to cover any adaptations or variations of the embodiments and disclosure. For example, although described in terminology and terms common to the field referenced hereinabove, one of ordinary skill in the art will appreciate that implementations can be made for other systems, apparatus or methods that provide the required function. In particular, one of ordinary skill in the art will readily appreciate that the names of the methods and apparatus are not intended to limit embodiments or the disclosure. Furthermore, additional methods, steps, and apparatus can be added to the components, functions can be rearranged among the components, and new components to correspond to future enhancements and physical devices used in embodiments can be introduced without departing from the scope of embodiments and the disclosure. One of skill in the art will readily recognize that embodiments are applicable to future systems, apparatus and processes. Terminology used in the present disclosure is intended to include all environments and alternate technologies which provide the same functionality described herein.

What is claimed is:

1. A rotary insert comprising:

a shank portion;

a stopper portion coupled to the shank portion; and a tip opposite the shank portion, the tip having a base coupled to the stopper portion, the tip extending away from the stopper portion along an axis of symmetry, the tip having a tip end spaced apart from the stopper portion, the tip comprising a first face disposed opposite a second face, the first face and the second face defining a continuous outer edge, the continuous outer edge extending from the tip end to the base;

the continuous outer edge intersecting the axis of symmetry at the tip end;

the outer edge having a maximum radius relative to the axis of symmetry at the base, the continuous outer edge from the tip end to the base tapering outward relative to the axis of symmetry;

from the tip end to the base the tip having at least one stage portion, the continuous outer edge curved in the at least one stage portion; and the stopper portion having a stopper radius greater than the maximum radius of the tip.

2. The insert of claim 1, the continuous outer edge comprising at least two stage portions, in each of the at least two stage portions the continuous outer edge having different curvature.

3. The insert of claim 1, the insert formed as a single element.

4. The insert of claim 1, the insert comprising metal.

5. The insert of claim 1, the insert comprising ceramic.

6. The insert of claim 1, the tip further comprising a flared bottom portion, the flared bottom portion affixed between the stopper portion and the at least one stage portion, at least two edges of the flared bottom portion sloping from the tip to the stopper portion.

7. The insert of claim 1, the rounded edges being equal in diameter.

8. The insert of claim 1, the at least one stage portion comprising one stage portion.

9. The insert of claim 1, the at least one stage portion comprising two stage portions.

10. A system comprising:

a rotary insert comprising:

a shank portion;

a stopper portion coupled to the shank portion; and a tip opposite the shank portion, the tip having a base coupled to the stopper portion, the tip extending away from the stopper portion along an axis of symmetry, the tip having a tip end spaced apart from the stopper portion, the tip comprising a first face disposed opposite a second face, the first face and the second face defining a continuous outer edge, the continuous outer edge extending from the tip end to the base;

the continuous outer edge intersecting the axis of symmetry at the tip end;

the outer edge having a maximum radius relative to the axis of symmetry at the base, the continuous outer edge from the tip end to the base tapering outward relative to the axis of symmetry;

from the tip end to the base the tip having at least one stage portion, the continuous outer edge curved in the at least one stage portion;

the stopper portion having a stopper radius greater than the maximum radius of the tip; and a drill engaging the shank portion.

11. The system of claim 10, the continuous outer edge comprising at least two stage portions, in each of the at least two stage portions the continuous outer edge having different curvature.

12. The system of claim 10, the insert formed as a single element.

13. The system of claim 10, the insert comprising metal.

14. The system of claim 10, the insert comprising ceramic.

15. The system of claim 10, further comprising a flared bottom portion, the flared bottom portion affixed between the stopper portion and the tip, at least two edges of the flared bottom portion sloping from the tip to the stopper portion.

16. The system of claim 10, the rounded edges being equal in diameter.

17. The system of claim 10, the at least one stage portion comprising one stage portion.

18. The system of claim 10, the at least one stage portion comprising two stage portions.

19. A method for flaring a tube, the method comprising:

coupling a rotary insert to a rotary power tool, the rotary insert comprising:

a tip opposite the shank portion, the tip having a base coupled to the stopper portion, the tip extending away from the stopper portion along an axis of symmetry, the tip having a tip end spaced apart from the stopper portion, the tip comprising a first face disposed opposite a second face, the first face and the second face defining a continuous outer edge, the continuous outer edge extending from the tip end to the base;

the continuous outer edge intersecting the axis of symmetry at the tip end;

the outer edge having a maximum radius relative to the axis of symmetry at the base, the continuous outer edge from the tip end to the base tapering outward relative to the axis of symmetry;

from the tip end to the base the tip having at least one stage portion, the continuous outer edge curved in the at least one stage portion; and the stopper portion having a stopper radius greater than the maximum radius of the tip;

inserting the rotary insert into an interior surface of a tube; and rotating the rotary insert to cause friction between the tip and the interior surface of the tube, to increase the diameter of at least a portion of the tube, to create a flare, and to increase structural quality of the tube from heat provided to the tube.

20. A method for swaging a tube, the method comprising:

coupling a rotary insert coupled to a rotary power tool, the rotary insert comprising:

a tip opposite the shank portion, the tip having a base coupled to the stopper portion, the tip extending away from the stopper portion along an axis of symmetry, the tip having a tip end spaced apart from the stopper portion, the tip comprising a first face disposed opposite a second face, the first face and the second face defining a continuous outer edge, the continuous outer edge extending from the tip end to the base;

the continuous outer edge intersecting the axis of symmetry at the tip end;

the outer edge having a maximum radius relative to the axis of symmetry at the base, the continuous outer edge from the tip end to the base tapering outward relative to the axis of symmetry;

from the tip end to the base the tip having at least one stage portion, the continuous outer edge curved in the at least one stage portion; and the stopper portion having a stopper radius greater than the maximum radius of the tip;

inserting the rotary insert into an interior surface of a tube; and rotating the rotary insert to cause friction between the tip and the interior surface of the tube, to increase the diameter of at least a portion of the tube, and to increase structural quality of the tube from heat provided to the tube.

* * * * *